United States Patent [19]

Mahler et al.

[11] 4,070,778

[45] Jan. 31, 1978

[54] GREETING CARD

[76] Inventors: Harry H. Mahler, 284 Main St., Centerville, Mass. 02632; John A. Spargo, Crosby Lane, East Brewster, Mass. 02631

[21] Appl. No.: 676,357

[22] Filed: Apr. 12, 1976

[51] Int. Cl.[2] ..... G09F 1/00

[52] U.S. Cl. ..... 40/124.1; 229/92.8

[58] Field of Search ..... 40/126 A, 125 A, 152.1, 40/155, 124.1, 158 R; 229/92.8

[56] References Cited

U.S. PATENT DOCUMENTS

| | | | |
|---|---|---|---|
| 2,279,164 | 4/1942 | Gettleman | 229/92.8 |
| 2,741,564 | 4/1956 | Mahler | 428/141 |

FOREIGN PATENT DOCUMENTS

| | | | |
|---|---|---|---|
| 32,738 | 1/1905 | Switzerland | 229/92.8 |
| 23,413 | 1/1902 | Switzerland | 229/92.8 |
| 8,420 of | 1904 | United Kingdom | 229/92.8 |

*Primary Examiner*—Louis G. Mancene
*Assistant Examiner*—Wenceslao J. Contreras

[57] ABSTRACT

A card has a first section shown as in the form of a picture postcard and a folded-over second section on the front of which there is a printed message and the back of which has pressure sensitive material enabling the card to be adhered to a display surface.

1 Claim, 3 Drawing Figures

GREETING CARD

BACKGROUND REFERENCES

U.S. Pat. No. 2,658,246
U.S. Pat. No. 2,699,999
U.S. Pat. No. 2,741,564

BACKGROUND OF THE INVENTION

Everyone is familiar with greeting cards of the type having a first section folded over a second section and covering a message thereon with the first section having a picture printed on its exposed face. Everyone is also familiar with the so-called "return" postal card.

Of such greeting cards, Christmas cards are the best example and a common practice is to position received cards to display them during the holiday season, after which they are usually discarded.

THE PRESENT INVENTION

The general objective of the present invention is to provide a card of the type having a first section folded over the second section for use when it is desired that the front or outer face of the first section or the front face of the second section be displayed, an objective attained with at least the back of the second section provided with means wholly or only partly covering it and enabling the card to be secured to a display surface without damage thereto when the card is removed therefrom. The inner face of the first section is in the form of a postal card and the invention is herein discussed primarily in connection with greeting cards by way of a preferred example with the outer face of the first section having a picture printed thereon thus enabling it to be used as a picture postcard once the occasion for which the card was sent has passed and the first section separated from the second section. The means by which the back of the second section may be secured to a display surface is a coat of an amorphous, crystalline hydrocarbon wax that is tacky at room temperature as a pressure-sensitive adhesive.

Another objective of the invention is to enable the exposed face of the first section to be provided with an identification of the occasion in connection with which the card is primarily to be used without preventing its secondary use, an objective attained by printing the identification adjacent one edge of the first section and providing score lines between said printing and the picture so that it may be separated therefrom.

BRIEF DESCRIPTION OF THE DRAWINGS

A preferred embodiment of the invention is illustrated in the accompanying drawings of which

THE PREFERRED EMBODIMENTS OF THE INVENTION

Figure 1:
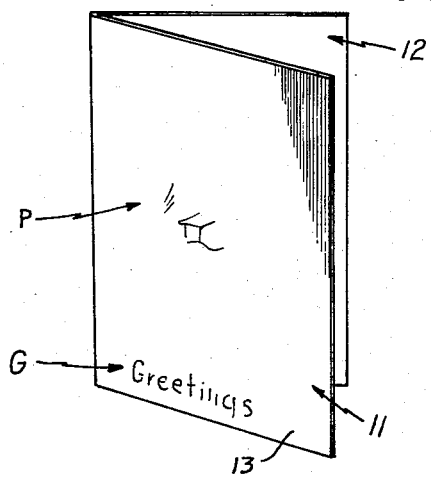
FIG. 1 is a perspective view of a typical greeting card in accordance with the invention.
Figure 2:
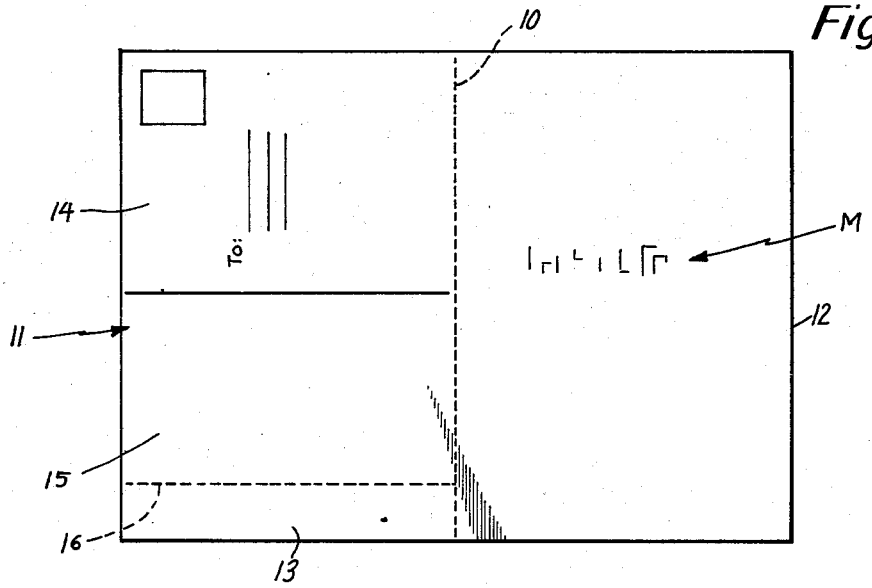
FIG. 2 is a view, on an increase in scale, with the card opened to show the back or inner face of the first section and the inner face of the second section exposed.
Figure 3:
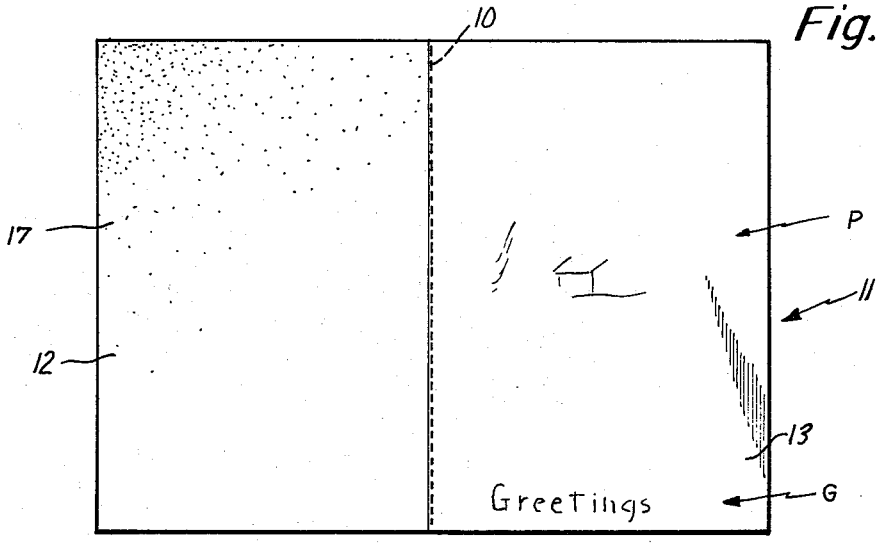
FIG. 3 is a like view but with the card turned over to show the coated back of the second section and the front of the first section.

The greeting card illustrated by the drawings is of the type formed from a rectangular and typically oblong sheet of suitable paper stock folded along a transverse center line 10 to provide a first or front section 11 and a second or back section 12. The fold line 10 is such as to facilitate the separation of the sections, and preferably consists of a series of score lines.

The front or exposed face of the first section 11 has a picture P printed thereon and, in addition, is shown as having a short greeting, indicated at G and appropriate for the ocassion the noting of which is the primary function of the greeting card. The greeting G occupies a relatively narrow area 13 located near and extending along one edge of the first section 11, preferably its bottom edge. The picture P is usually but not necessarily one of general interest apart from the noted occasion being, by way of examples, that of a historic site, an attractive landscape, or of wildlife.

The back or concealed face of the first section 11 is in the form of a postal card and has one part 14 for an address and stamp and another part 15 for a written message. A line 16 in the part 15 is the dividing line between the area 13 and the remainder of the first section 11 and is preferably a series of score lines.

The front face of the second section 12 has a message M written or printed thereon and the name or names of those sending the card and its rear or back face is provided with a pressure sensitive adhesive coat 17 enabling that section 12 to be secured against a suitable surface for display purposes.

The coat 17 is of the type described in detail in my U.S. Pat. No. 2,741,564. In brief it is an amorphous, crystalline hydrocarbon wax having a melting point in the approximate range of from 150° to 175° F and being tacky at room temperatures. When such a wax dries, after a sheet is coated with a thin layer thereof, a crystalline structure results in the form of a fine screen-line finish. With such a coat, an article can be secured to a suitably smooth surface by pressing the thus coated article thereagainst.

An important advantage of such a coat is that, to secure adhesion, the article must be pressed firmly and with considerable pressure against the surface and the article may be removed from the surface without leaving a trace. The first named advantage ensures that the greeting card will not become attached to its envelope either prior to use or when mailed.

When a card is no longer to be displayed, the first section 11 is torn or cut free from the section 12 and may be used as a postal card, with the area 13 detachable for general purposes but with the area included if used for the purpose indicated by the greeting G.

We claim:

1. A greeting card comprising first and second sections with the first section folded over the second section, the junction of the two sections having a score line extending from end-to-end thereof to enable the first and second sections to be easily separated, the exposed face of the first section having a picture printed thereon and its other face having a space for an address and a space for a message and at least a part of the back face of the second section includes a coat of a pressure-sensitive adhesive enabling said card to be removably secured thereby to a vertical display surface, the first section when later detached useable as a postcard and having a message printed on the exposed face of the first section adjacent the bottom edge thereof and below the picture, and the first section having a transverse score line extending from the free side edge thereto to said first named score line and enabling the message area to be separated from the picture area.

* * * * *